US011488767B2

(12) United States Patent
Jung et al.

(10) Patent No.: US 11,488,767 B2
(45) Date of Patent: Nov. 1, 2022

(54) COIL COMPONENT

(71) Applicant: SAMSUNG ELECTRO-MECHANICS CO., LTD., Suwon-si (KR)

(72) Inventors: Jung Hyuk Jung, Suwon-si (KR); Young Sun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 350 days.

(21) Appl. No.: 16/869,931

(22) Filed: May 8, 2020

(65) Prior Publication Data

US 2021/0134521 A1 May 6, 2021

(30) Foreign Application Priority Data

Oct. 31, 2019 (KR) ..... 10-2019-0137555

(51) Int. Cl.

| | |
|---|---|
| ***H01F 27/29*** | (2006.01) |
| ***H01F 27/24*** | (2006.01) |
| ***H01F 27/28*** | (2006.01) |
| ***H01F 41/04*** | (2006.01) |

(52) U.S. Cl.

CPC ..... *H01F 27/29* (2013.01); *H01F 27/24* (2013.01); *H01F 27/2804* (2013.01); *H01F 41/041* (2013.01); *H01F 2027/2809* (2013.01)

(58) Field of Classification Search

CPC ..... H01F 27/29; H01F 27/24; H01F 27/2804
USPC ..... 336/192
See application file for complete search history.

(56) References Cited

U.S. PATENT DOCUMENTS

2012/0119863 A1 5/2012 Wu
2016/0078986 A1* 3/2016 Yoon ..... H01F 3/00 336/83
2016/0078994 A1* 3/2016 Yoon ..... H01F 5/00 336/200

(Continued)

FOREIGN PATENT DOCUMENTS

JP 6299868 B2 3/2018
KR 10-2015-0089279 A 8/2015

(Continued)

OTHER PUBLICATIONS

Korean Office Action dated Sep. 18, 2020 issued in Korean Patent Application No. 10-2019-0137555 (with English translation).

*Primary Examiner* — Alfonso Perez Borroto
(74) *Attorney, Agent, or Firm* — Morgan, Lewis & Bockius LLP

(57) ABSTRACT

A coil component includes a body having a first surface and a second surface, both side surfaces, and both end surfaces connecting the first surface to the second surface and opposing each other, a plurality of coil portions embedded in the body and spaced apart from each other, first to fourth side electrodes connected to the plurality of coil portions and exposed to the both side surfaces, respectively, and first to fourth external electrodes disposed on the first surface and connected to the first to fourth side electrodes, respectively. A length of an edge of each of the first to fourth external electrodes, contacting the first surface and one of the both side surfaces, is greater than a length of an edge of a respective one of the first to fourth side electrodes, contacting the first surface and one of the both side surfaces.

20 Claims, 4 Drawing Sheets

(56) References Cited

U.S. PATENT DOCUMENTS

| | | | | |
|---|---|---|---|---|
| 2016/0078995 | A1* | 3/2016 | Yoon | H01F 17/0013 336/200 |
| 2016/0126006 | A1 | 5/2016 | Ahn et al. | |
| 2017/0032887 | A1 | 2/2017 | Hamada et al. | |
| 2019/0088406 | A1* | 3/2019 | Kim | H01F 27/29 |

FOREIGN PATENT DOCUMENTS

| | | | |
|---|---|---|---|
| KR | 10-2016-0032580 | A | 3/2016 |
| KR | 10-2016-0051583 | A | 5/2016 |

* cited by examiner

COIL COMPONENT

CROSS-REFERENCE TO RELATED APPLICATION(S)

The present application claims the benefit of priority to Korean Patent Application No. 10-2019-0137555, filed on Oct. 31, 2019 in the Korean Intellectual Property Office, the entire disclosure of which is incorporated herein by reference.

TECHNICAL FIELD

The present disclosure relates to a coil component.

BACKGROUND

Inductors as coil components are typical passive electronic components used in electronic devices, in addition to resistors and capacitors.

As electronic devices are gradually implemented with high-performance and become smaller, the number of electronic components used in electronic devices is increasing and the electronic components are miniaturized.

Accordingly, there is increasing demand for a coiled component of a coupled type to reduce the mounting area of components. Accordingly, increasing the efficiency of components within the same size by appropriately modifying the shape of a coil portion of a coupled inductor is required according to needs.

When a coupled inductor is used as described above, a plurality of coil portions may be designed in various forms, such that a plurality of lead-out portions are disposed on the side of the body. In this case, there is a need to prevent short circuits between a side electrode and a mounting substrate while improving the fixing strength between the side electrode and an external electrode disposed on the bottom surface of the body.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a coil component in which the efficiency of a component may be increased in an inductor having a plurality of coil portions.

An aspect of the present disclosure is to provide a coil component in which short circuit between a side electrode and a mounting substrate may be prevented while improving the fixing strength between an external electrode and the side electrode in an inductor having a plurality of coil portions.

According to an aspect of the present disclosure, a coil component includes a body having a first surface and a second surface opposing each other, both sides connecting the first surface to the second surface and opposing each other, and both end surfaces connecting the first surface to the second surface and opposing each other, a plurality of coil portions embedded in the body and spaced apart from each other, first to fourth side electrodes connected to the plurality of coil portions and exposed to the both side surfaces of the body, respectively, and first to fourth external electrodes disposed on the first surface of the body and connected to the first to fourth side electrodes, respectively. A length of an edge of each of the first to fourth external electrodes, contacting the first surface of the body and one of the both sides of the body, is greater than a length of an edge of a respective one of the first to fourth side electrodes, contacting the first surface and one of the both side surfaces of the body.

According to another aspect of the present disclosure, a coil component includes a body having a first surface and a second surface opposing each other, both side surfaces connecting the first surface to the second surface and opposing each other, and both end surfaces connecting the first surface to the second surface and opposing each other in a width direction of the body; a plurality of coil portions including a plurality of winding portions respectively having at least one turn around a plurality of cores spaced apart from each other inside the body, and a plurality of extension portions extending from the plurality of winding portions, respectively; first to fourth side electrodes, connected to the plurality of coil portions, disposed on the both side surfaces of the body, respectively, and spaced apart from each other; and first to fourth external electrodes, connected to the first to fourth side electrodes, respectively, disposed on the first surface of the body and spaced apart from each other, wherein a length of each of the first to fourth external electrodes in the width direction of the body is greater than a length of each of the first to fourth side electrodes in the width direction of the body.

According to still another aspect of the present disclosure, a coil component includes a body having a first surface and a second surface opposing each other, both side surfaces connecting the first surface to the second surface and opposing each other, and both end surfaces connecting the first surface to the second surface and opposing each other; first and second coil portions embedded in the body and spaced apart from each other; first and second side electrodes disposed on a first side surface of the both side surfaces of the body and connected to both ends of the first coil portion, respectively; and third and fourth side electrodes disposed on a second side surface of the both side surfaces of the body and connected to both ends of the second coil portion, respectively. The first to fourth side electrodes include first to fourth external electrodes, respectively, extending from the first to fourth side electrodes, respectively, onto the first surface of the body. The first and second external electrodes include first and second protrusions, respectively, extending toward each other in opposite directions and were spaced apart from each other. The third and fourth external electrodes include third and fourth protrusions, respectively, extending toward each other in opposite directions and were spaced apart from each other.

BRIEF DESCRIPTION OF THE DRAWINGS

The above and other aspects, features, and advantages of the present disclosure will be more clearly understood from the following detailed description, taken in conjunction with the accompanying drawings, in which.

DETAILED DESCRIPTION

Figure 1:
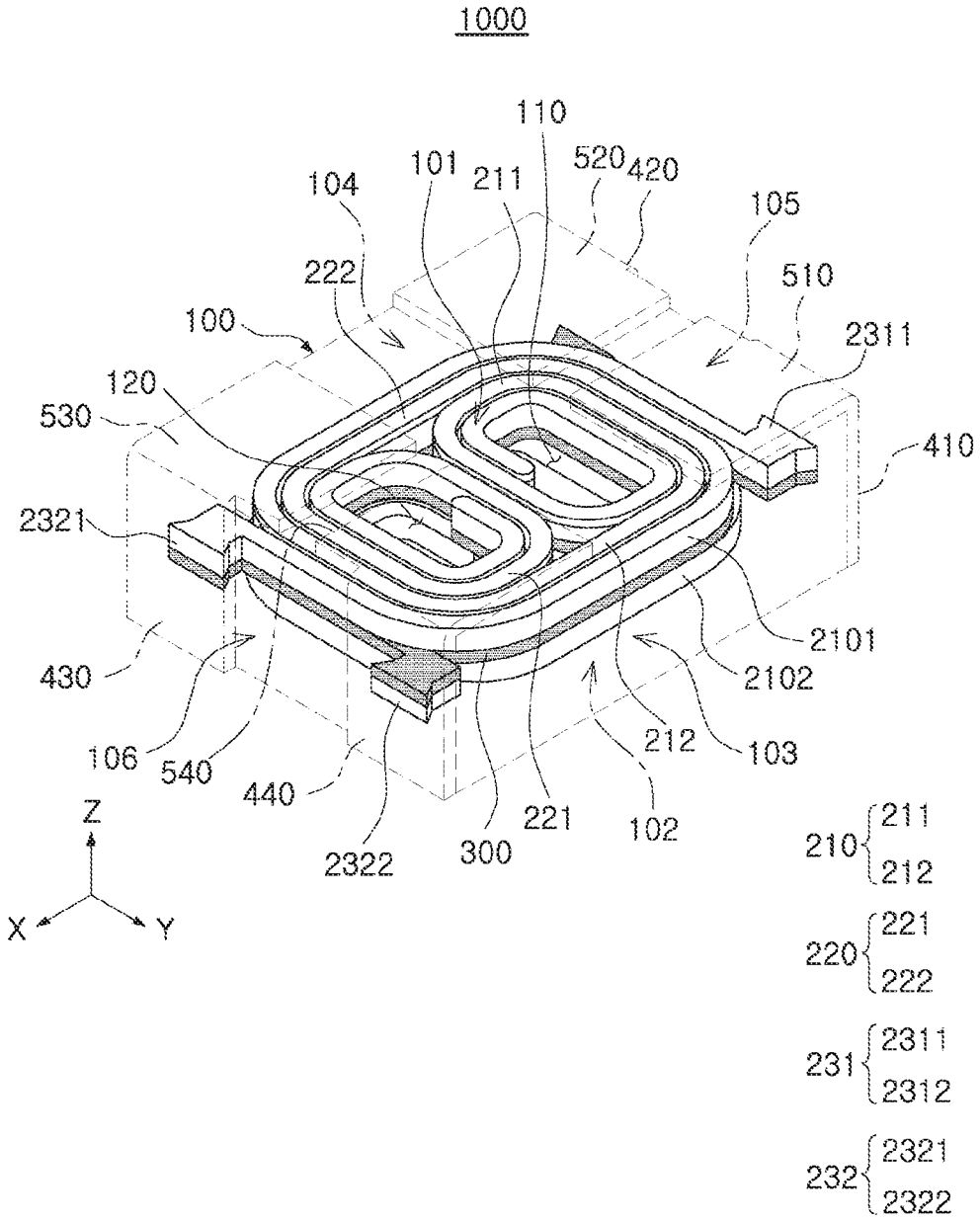
FIG. 1 is a side perspective view schematically illustrating a coil component according to an exemplary embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative size, proportions, and depiction of elements in the drawings may be exaggerated for clarity, illustration, and convenience.

In addition, the combination means not only a case in which respective components are physically in direct contact with each other in a contact relationship between the respective components, but also a case in which other components are interposed between the respective components to be in direct contact with each other.

Since the size and thickness of each component illustrated in the drawings are arbitrarily illustrated for convenience of description, the present disclosure is not necessarily limited to what is illustrated.

In the drawings, an X direction may be defined as a first direction or a longitudinal direction, a Y direction as a second direction or a width direction, and a Z direction as a third direction or a thickness direction.

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

Hereinafter, a coil component according to an exemplary embodiment will be described in detail with reference to the accompanying drawings, and in describing with reference to the accompanying drawings, the same or corresponding components are assigned the same reference numbers and overlapped descriptions thereof will be omitted.

Various types of electronic components are used in electronic devices, and various types of coil components may be appropriately used to remove noise between the electronic components.

For example, in electronic devices, coil components may be used as power inductors, high-frequency (HF) inductors, general beads, high-frequency beads, common mode filters, or the like.

Coil Component

Figure 2:
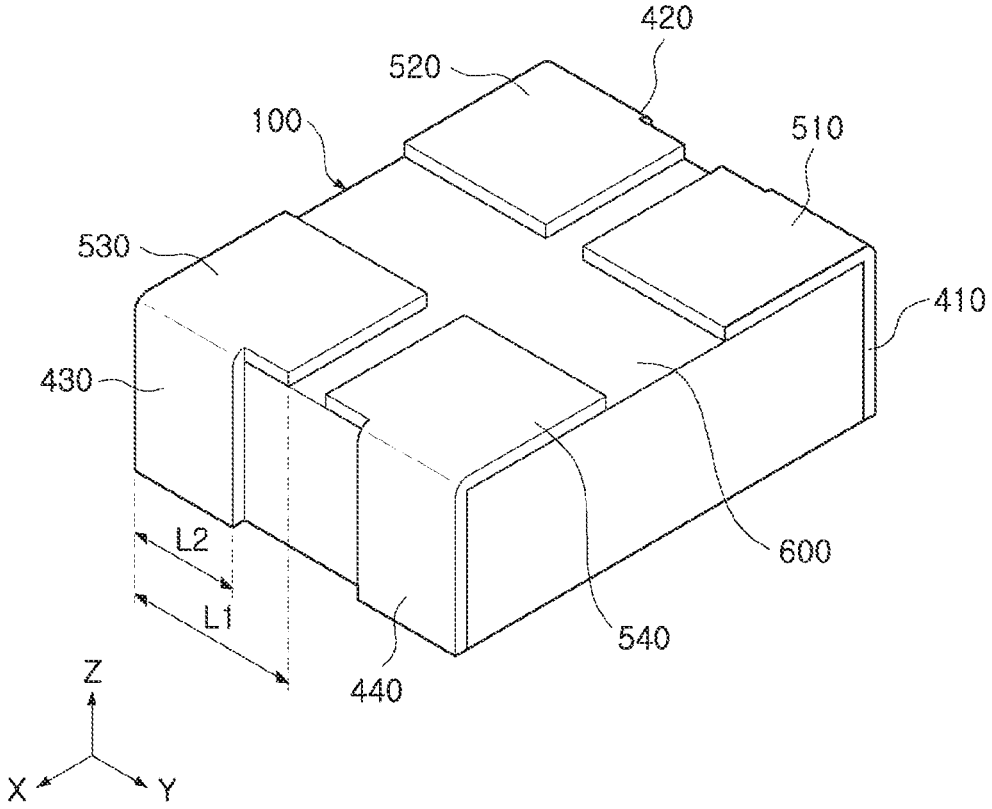
FIG. 2 is a side perspective view illustrating an external electrode and a side electrode of the coil component of FIG. 1.
Figure 3:
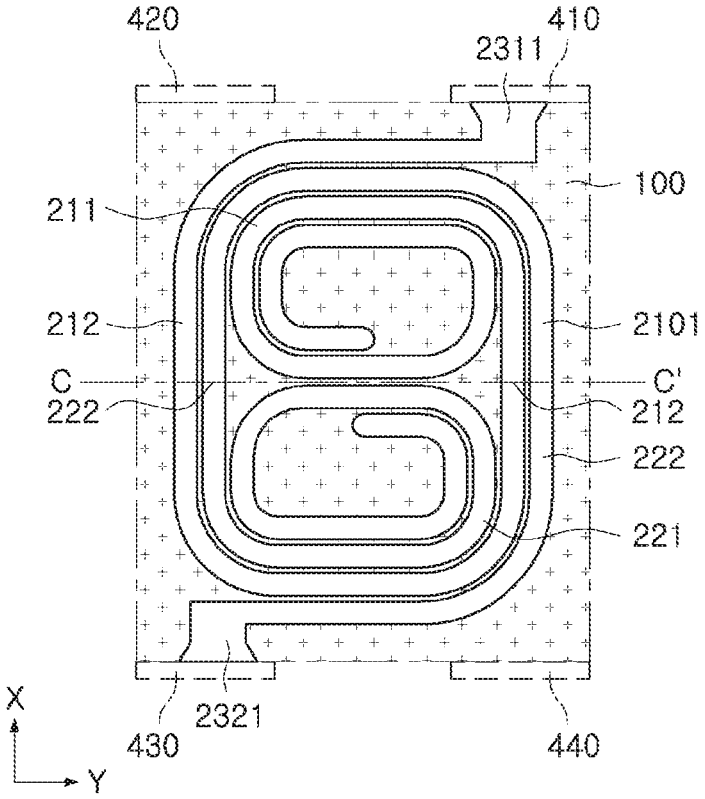
FIG. 3 schematically illustrates a first coil layer of the coil component of FIG. 1.
Figure 4:
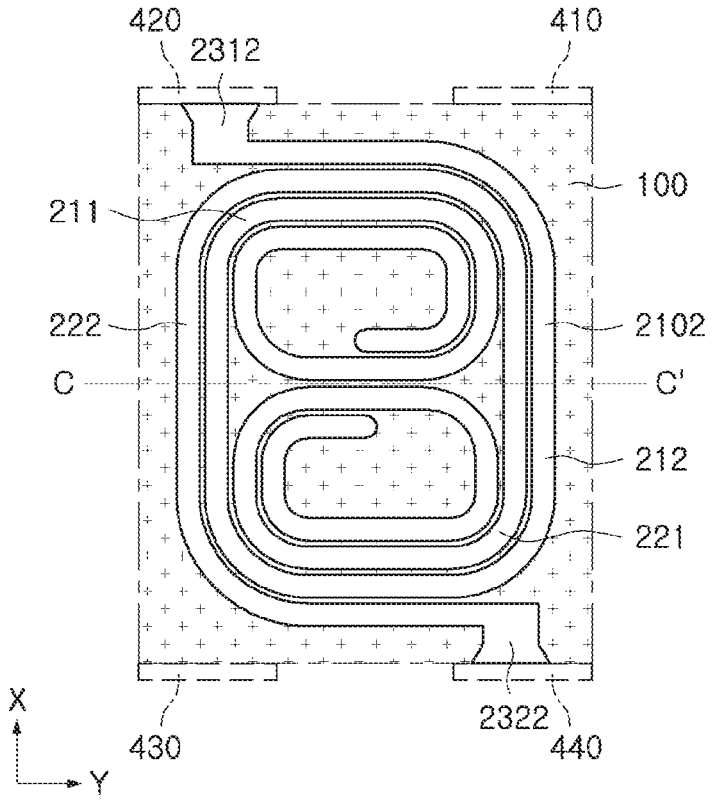
FIG. 4 schematically illustrates a second coil layer of the coil component of FIG. 1.

FIG. 1 is a side perspective view schematically illustrating a coil component according to an exemplary embodiment. FIG. 2 is a side perspective view illustrating external and side electrodes of the coil component of FIG. 1. FIG. 3 is a view schematically illustrating a first coil layer of the coil component of FIG. 1. FIG. 4 is a view schematically illustrating a second coil layer of the coil component of FIG. 1.

Referring to FIGS. 1 to 4, a coil component 1000 according to an exemplary embodiment includes a body 100, first and second coil portions 210 and 220, a support substrate 300, first to fourth side electrodes 410, 420, 430 and 440, first to fourth external electrodes 510, 520, 530 and 540, and an insulating layer 600.

The body 100 may be formed to have a hexahedral shape as a whole.

Based on FIG. 1, the body 100 includes a first surface 101 and a second surface 102 opposing each other in a thickness direction Z, a third surface 103 and a fourth surface 104 opposing each other in a width direction Y, and a fifth surface 105 and a sixth surface 106 opposing each other in a longitudinal direction X. In this embodiment, the first surface 101 and the second surface 102 of the body 100 may refer to one surface and the other surface of the body 100, respectively, the fifth surface 105 and the sixth surface 106 of the body 100 may refer to one side and the other side of the body 100, respectively, and the third surface 103 and the fourth surface 104 of the body 100 may refer to one end surface and the other end surface of the body 100, respectively.

The body 100 includes first and second cores 110 and 120 that penetrate through the first and second coil portions 210 and 220, respectively, and are spaced apart from each other. The first and second cores 110 and 120 may be formed by filling through-holes of the first and second coil portions 210 and 220 with a magnetic composite sheet, but the embodiment is not limited thereto.

The body 100 may include a magnetic material and a resin. In detail, the body 100 may be formed by laminating one or more magnetic composite sheets including a resin and a magnetic material dispersed in the resin. The body 100 may also have a structure other than the structure in which the magnetic material is dispersed in the resin. For example, the body 100 may be formed of a magnetic material such as ferrite.

The magnetic material may be ferrite or metal magnetic powder.

The ferrite powder may be at least one of, for example, spinel ferrites such as Mg—Zn, Mn—Zn, Mn—Mg, Cu—Zn, Mg—Mn—Sr, Ni—Zn and the like, hexagonal ferrites such as Ba—Zn, Ba—Mg, Ba—Ni, Ba—Co, Ba—Ni—Co and the like, garnet ferrites such as Y, and Li ferrites.

The magnetic metal powder may any one or more selected from the group consisting of iron (Fe), silicon (Si), chromium (Cr), cobalt (Co), molybdenum (Mo), aluminum (Al), niobium (Nb), copper (Cu) and nickel (Ni). For example, the magnetic metal powder may be at least one or more of pure iron powder, Fe—Si alloy powder, Fe—Si—Al alloy powder, Fe—Ni alloy powder, Fe—Ni—Mo alloy powder, Fe—Ni—Mo—Cu alloy powder, Fe—Co alloy powder, Fe—Ni—Co alloy powder, Fe—Cr alloy powder, Fe—Cr—Si alloy powder, Fe—Si—Cu—Nb alloy powder, Fe—Ni—Cr alloy powder and Fe—Cr—Al alloy powder.

The magnetic metal powder may be amorphous or crystalline. For example, the magnetic metal powder may be Fe—Si—B—Cr-based amorphous alloy powder, but is not limited thereto.

The ferrite power and the magnetic metal powder may have an average diameter of about 0.1 μm to 30 μm, respectively, but the diameters thereof are not limited thereto.

The body 100 may include two or more types of magnetic materials dispersed in a resin. In this case, the fact that the magnetic materials are different types means that the magnetic materials dispersed in the resin are distinguished from each other by any one of an average diameter, a composition, crystallinity, and a shape.

The resin may include an epoxy, polyimide, a liquid crystal polymer, or the like, alone or in combination, but is not limited thereto.

The first and second coil portions 210 and 220 are embedded to be spaced apart from each other inside the body 100, thereby exhibiting characteristics of the coil component.

The first and second coil portions 210 and 220 according to this embodiment include first and second winding portions 211 and 221, first and second extension portions 212 and 222, and first and second lead-out portions 231 and 232.

Referring to FIGS. 1 and 3 to 4, the first and second coil portions 210 and 220 include a plurality of straight portions and a plurality of curved portions connecting the plurality of straight portions to each other. In this embodiment, the curved portion refers to a corner section in which the winding direction of each coil portion 210 or 220 is switched, and the straight portion refers to a straight section connecting the curved portions. Although not illustrated in detail, the first and second extension portions 212 and 222 have four curved portions in corner sections, respectively, and four straight portions connecting the curved portions. Similarly, the first and second winding portions 211 and 221 also have four curved portions in corner sections, respectively, and four straight portions connecting the curved portions. As described above, since the first and second coil portions 210 and 220 have curved portions, a space in which the first and second coil portions 210 and 220 are spaced apart from each other may be formed. The space is disposed between the curved portions of the first winding portion 211 and the curved portions of the second winding portion 221.

Referring to FIGS. 3 to 4, the first and second coil portions 210 and 220 include first and second winding portions 211 and 221 forming at least one turn around the first and second cores 110 and 120, and first and second extension portions 212 and 222 extending from the first and second winding portions 211 and 221, to surround the first and second cores 110 and 120, respectively. Referring to FIGS. 1 and 3, the first extension portion 212 connects the first lead-out portion 231 and the first winding portion 211 to be described later, to surround both the first and second winding portions 211 and 221. The second extension portion 222 connects the second lead-out portion 232 and the second winding portion 221 to surround both the first and second winding portions 211 and 221. Referring to FIGS. 3 to 4, a center line C-C' is an arbitrary baseline parallel to the width direction Y of the body 100 and disposed between the two winding portions 211 and 221 to pass through spaces spaced apart from each other. For example, the first extension portion 212 indicates a portion of the coil portions 210 and 220, wound to sequentially surround the first and second winding portions 211 and 221 by extending from the first lead-out portion 231 to be described later and reaching the center line C-C'. The second extension portion 222 indicates a portion of the coil portions 210 and 220, wound to sequentially surround the second and first winding portions 221 and 211 by extending from the second lead-out portion 232 to be described later and reaching the center line C-C'. As a result, the first extension portion 212 wound to sequentially surround the first and second winding portions 211 and 221, and the second extension portion 222 wound to sequentially surround the second and first winding portions 221 and 211, may be alternately disposed.

Referring to FIGS. 3 and 4, the first and second coil portions 210 and 220 include a first coil layer 2101 disposed on one surface of the support substrate 300, and a second coil layer 2102 disposed on the other surface of the support substrate 300 and facing the first coil layer 2101.

Referring to FIGS. 1, 3 and 4, the first coil portion 210 further includes the first lead-out portion 231 exposed to the fifth surface 105 of the body 100, and the second coil portion 220 further includes the second lead-out portion 232 exposed to the sixth surface 106 of the body 100. The first extension portion 211 connects the first coil portion 210 and the first lead-out portion 231, and the second extension portion 222 connects the second coil portion 220 and the second lead-out portion 232. The first extension portion 212 connects the first lead-out portion 232 and the first winding portion 211 to surround the second winding portion 221, and the second extension portion 222 connects the second lead-out portion 232 and the second winding portion 221 to surround the first winding portion 211. In addition, the first lead-out portion 231 includes first and second lead patterns 2311 and 2312 that are exposed to the fifth surface 105 of the body 100 to be spaced apart from each other, and the second lead-out portion 232 includes third and fourth lead patterns 2321 and 2322 that are exposed to the sixth surface 106 of the body 100 to be spaced apart from each other.

The first and second coil layers 2101 and 2102 may be connected by vias (not illustrated), respectively.

The first and second coil portions 210 and 220 and the via (not illustrated) may include at least one conductive layer.

For example, when the first and second coil portions 210 and 220 and the via (not illustrated) are formed by plating on one surface of the support substrate 100, the first and second coil portions 210 and 220 and the via (not illustrated) may each include a seed layer such as an electroless plating layer and an electroplating layer. In this case, the electroplating layer may have a single layer structure or a multilayer structure. The multi-layered electroplating layer may be formed in a conformal film structure in which one electroplating layer is covered by another electroplating layer, or may be formed to have a shape in which another electroplating layer is stacked only on one surface of one electroplating layer. The seed layers of the first and second coil portions 210 and 220 and the seed layer of the via (not illustrated) may be integrally formed, so that a boundary therebetween may not be formed, but the embodiments are not limited thereto. The electroplating layers of the first and second coil portions 210 and 220 and the electroplating layer of the via (not illustrated) may be integrally formed, so that a boundary therebetween may not be formed, but the embodiments are not limited thereto.

The first and second coil portions 210 and 220, and the via (not illustrated) may be respectively formed of a conductive material such as copper (Cu), aluminum (Al), silver (Ag), tin (Sn), gold (Au), nickel (Ni), lead (Pb), titanium (Ti), or alloys thereof, but the material is not limited thereto.

The support substrate 300 is embedded in the body 100 and is spaced apart inside the body 100. The support substrate 300 includes one surface and the other surface opposing the one surface, and supports the first and second coil portions 210 and 220.

The support substrate 300 is formed of an insulating material including a thermosetting insulating resin such as an epoxy resin, a thermoplastic insulating resin such as polyimide, or a photoimageable dielectric resin, or may be formed of an insulating material in which a reinforcing material such as glass fiber or inorganic filler is impregnated in such an insulating resin. As an example, the support substrate 300 may be formed of an insulating material such as prepreg, Ajinomoto Build-up Film (ABF), FR-4, a bismaleimide triazine (BT) resin, Photoimageable Dielectric (PID) or the like, but the present disclosure is not limited thereto.

As the inorganic filler, at least one or more selected from the group consisting of silica ($SiO_2$), alumina ($Al_2O_3$), silicon carbide (SiC), barium sulfate ($BaSO_4$), talc, mud, mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

When the support substrate 300 is formed of an insulating material including a reinforcing material, the support substrate 300 may provide relatively superior rigidity. When the support substrate 300 is formed of an insulating material that does not contain glass fiber, the support substrate 300 is advantageous in terms of reducing the overall thickness of the first and second coil portions 210 and 220. When the support substrate 300 is formed of an insulating material including a photoimageable dielectric resin, the number of processes of forming the first and second coil portions 210 and 220 may be reduced, which is advantageous in reducing production costs and in forming a fine via.

The first to fourth side electrodes 410, 420, 430 and 440 are exposed to the fifth and sixth surfaces 105 and 106 of the body 100, and are connected to the first and second coil portions 210 and 220. In detail, the first and second side electrodes 410 and 420 are connected to the first coil portion 210 and are respectively exposed to the fifth surface 105 of the body 100, and the third and fourth side electrodes 430 and 440 are connected to the second coil portion 220 and are respectively exposed to the sixth surface 106 of the body 100.

Referring to FIGS. 1 and 2, the first to fourth side electrodes 410, 420, 430 and 440 are disposed on edge regions in which both sides and both end surfaces of the body 100 are in contact with each other, respectively. In detail, the first side electrode 410 is disposed on an edge region of the fifth surface 105 contacting the third surface 103 of the body 100, and the second side electrode 420 is disposed on an edge region of the fifth surface 105 of the body 100 contacting the fourth surface 104 of the body 100. The third side electrode 430 is disposed on an edge region of the sixth surface 106 of the body 100 contacting the fourth surface 104 of the body 100, and the fourth side electrode 440 is disposed on an edge region of the sixth surface 106 of the body 100 contacting the third surface 103 of the body 100. For example, the first and second side electrodes 410 and 420 are located on both end portions of the fifth surface 105 of the body 100, spaced apart from each other in the width direction Y, and the third and fourth side electrodes 430 and 440 are disposed on both end portions of the sixth surface 106 of the body 100, spaced apart from each other in the width direction Y. As a result, compared to a case in which the first to fourth side electrodes 410, 420, 430 and 440 are not disposed on the edge regions of the body 100; since the lengths of the edges contacting the external electrodes 510, 520, 530 and 540 are relatively increased, the adhesion strength between the external electrodes 510, 520, 530 and 540 and the side electrodes 410, 420, 430 and 440 may be improved.

Referring to FIGS. 1, 3 and 4, the first and second side electrodes 410 and 420 are respectively connected to the first lead-out portion 231, and the third and fourth side electrodes 430 and 440 are respectively connected to the second lead-out portion 232. In detail, the first and second side electrodes 410 and 420 are connected to the first and second lead patterns 2311 and 2312, respectively, and the third and fourth side electrodes 430 and 440 are connected to the second and four lead patterns 2321 and 2322, respectively.

The first to fourth external electrodes 510, 520, 530 and 540 are disposed on the first surface 101 of the body 100, and are connected to the first to fourth side electrodes 410, 420, 430 and 440, respectively. Referring to FIGS. 1, 3 and 4, the first and second external electrodes 510 and 520 are respectively connected to the first and second side electrodes 410 and 420, which are connected to the first and second lead patterns 2311 and 2312, respectively, and the third and fourth external electrodes 530 and 540 are respectively connected to the third and fourth side electrodes 430 and 440, which are connected to the third and fourth lead patterns 2321 and 2322, respectively. Referring to FIG. 1, the first and second external electrodes 510 and 520 are disposed on corners of the first surface 101 of the body 100, contacting the fifth surface 105 of the body 100, respectively, to be spaced apart from each other; and the third and fourth external electrodes 530 and 540 are disposed on corners of the first surface 101, contacting the sixth surface 106 of the body 100, respectively, to be spaced apart from each other. In addition, the first and fourth external electrodes 510 and 540 are disposed on the corners of the first surface 101 of the body 100 contacting the third surface 103 of the body 100, and the second and third external electrodes 520 and 530 are disposed on the corners of the first surface 101 contacting the fourth surface 104 of the body 100, to be spaced apart from each other, respectively.

Referring to FIG. 2, a length L1 of an edge of the third external electrode 530, contacting the first surface 101 of the body 100 and the sixth surface 106 of the body 100, is greater than a length L2 of an edge of the third side electrode 430, contacting the first surface 101 of the body 100 and the sixth surface 106 of the body 100. On the other hand, for convenience, FIG. 2 illustrates with respect to only the lengths of the edges of the third external electrode 530 and the third side electrode 430, but the same description may be applied to the first, second and fourth external electrodes 510, 520 and 540 and the first, second and fourth side electrodes 410, 420 and 440. For example, among the first to fourth external electrodes 510, 520, 530 and 540, the lengths of the edges of the external electrodes, contacting the first surface 101 of the body 100 and the first surface 101 and the sixth surface 106 of the body 100, are greater than the lengths of the edges of the side electrodes, contacting the first surface 101 of the body 100 and the fifth surface 105 and the sixth surface 106 of the body 100, among the first to fourth side electrodes 410, 420, 430 and 440.

As a result, the area occupied by the side electrodes 410, 420, 430 and 440 on the external surface of the body 100 may be reduced. In addition, when mounting on the substrate, through the side electrodes 410, 420, 430 and 440 disposed on the sides of the body 100, the problem of electrical short-circuits with the mounting substrate may be significantly reduced. In detail, in a coupled inductor having a plurality of coil portions 210 and 220 as in this embodiment, the size of the side electrodes 410, 420, 430 and 440 may be reduced, and a short circuit with the mounting substrate may be prevented, which is advantageous for miniaturization of all components.

The first to fourth external electrodes 510, 520, 530 and 540 may be formed after the insulating layer 600 to be described later is first formed on the surface of the body 100 excluding regions in which the first to fourth external electrodes 510, 520, 530 and 540 and the first to fourth side electrodes 410, 420, 430 and 440 are to be formed. For example, the insulating layer 600 may be used as a plating resist.

The first to fourth external electrodes 510, 520, 530 and 540 may be formed using a paste containing a metal having excellent electrical conductivity, for example, using a conductive paste including nickel (Ni), copper (Cu), tin (Sn), silver (Ag) or the like, alone or alloys thereof. In addition, a plating layer may be further formed on each of the first to fourth external electrodes 510, 520, 530 and 540. In this case, the plating layer may include one or more selected from the group consisting of nickel (Ni), copper (Cu), and tin (Sn), and for example, a nickel (Ni) layer and a tin (Sn) layer may be sequentially formed.

The insulating layer 600 is formed on the region of the external surface of the body except for the regions of the surfaces on which the first to fourth side electrodes 410, 420, 430 and 440 and the first to fourth external electrodes 510, 520, 530 and 540 are formed. The insulating layer 600 may be used as long as it is formed of a material having insulating properties without limiting a material, and may be formed in a paste form. As described above, since the insulating layer 600 may be first printed in a paste form in regions other than regions in which the external electrodes 510, 520, 530 and 540 and the side electrodes 410, 420, 430 and 440 are to be formed; when the external electrodes 510, 520, 530 and 540 or the side electrodes 410, 420, 430 and 440 are formed, the shape of the electrode may be easily adjusted to a required form.

As set forth above, in an inductor having a plurality of coil portions according to an exemplary embodiment, the efficiency of components may be increased compared to those having the same size.

Further, according to an exemplary embodiment, in an inductor having a plurality of coil portions, short circuits between the side electrode and the mounting substrate may be prevented while improving the fixing strength between the external electrode and the side electrode.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil component comprising:

a body having a first surface and a second surface opposing each other, both side surfaces connecting the first surface to the second surface and opposing each other, and both end surfaces connecting the first surface to the second surface and opposing each other;

a plurality of coil portions embedded in the body and spaced apart from each other;

first to fourth side electrodes connected to the plurality of coil portions and exposed to the both side surfaces of the body, respectively; and first to fourth external electrodes disposed on the first surface of the body and connected to the first to fourth side electrodes, respectively, wherein a length of an edge of each of the first to fourth external electrodes, contacting the first surface and one of the both side surfaces of the body, is greater than a length of an edge of a respective one of the first to fourth side electrodes, contacting the first surface and one of the both side surfaces of the body.

2. The coil component of claim 1, wherein the first to fourth side electrodes are disposed on edge regions of the both side surfaces, respectively, and spaced apart from each other, and the edge regions refer to regions at which the both side surfaces and the both end surfaces of the body are in contact with each other, respectively.

3. The coil component of claim 1, wherein the first to fourth external electrodes are disposed on corners of the first surface of the body and spaced apart from each other, and the corners contact the both side surfaces and the both end surfaces of the body, respectively.

4. The coil component of claim 1, further comprising an insulating layer disposed on an external surface of the body, except for regions of the external surface on which the first to fourth side electrodes and the first to fourth external electrodes are disposed.

5. The coil component of claim 4, wherein the insulating layer includes an insulating paste.

6. A coil component comprising:

a body having a first surface and a second surface opposing each other, both side surfaces connecting the first surface to the second surface and opposing each other, and both end surfaces connecting the first surface to the second surface and opposing each other in a width direction of the body;

a plurality of coil portions including a plurality of winding portions respectively having at least one turn around a plurality of cores spaced apart from each other inside the body, and a plurality of extension portions extending from the plurality of winding portions, respectively;

first to fourth side electrodes, connected to the plurality of coil portions, disposed on the both side surfaces of the body, respectively, and spaced apart from each other; and first to fourth external electrodes, connected to the first to fourth side electrodes, respectively, disposed on the first surface of the body and spaced apart from each other, wherein a length of each of the first to fourth external electrodes in the width direction of the body is greater than a length of each of the first to fourth side electrodes in the width direction of the body.

7. The coil component of claim 6, wherein the first and second side electrodes are disposed on a first side surface of the both side surfaces and spaced apart from each other in the width direction of the body, and the third and fourth side electrodes are disposed on a second side surface of the both side surfaces and spaced apart from each other in the width direction of the body.

8. The coil component of claim 6, wherein the body comprises a first core and a second core spaced apart from each other, and the plurality of coil portions comprise:

a first coil portion including a first winding portion having at least one turn around the first core and a first extension portion extending from the first winding portion to surround the first winding portion, and a second coil portion including a second winding portion having at least one turn around the second core and a second extension portion extending from the second winding portion to surround the second winding portion.

9. The coil component of claim 8, wherein the first and second coil portions further comprise:

a first lead-out portion connected to the first extension portion and exposed to a first side surface of the both side surfaces of the body; and a second lead-out portion connected to the second extension portion and exposed to a second side surface of the both side surfaces of the body.

10. The coil component of claim 8, further comprising a support substrate having a first surface and a second surface opposing each other and supporting the first and second coil portions, wherein the first and second coil portions further comprise:

a first coil layer disposed on the first surface of the support substrate; and a second coil layer disposed on the second surface of the support substrate and facing the first coil layer.

11. The coil component of claim 9, wherein each of the first and second side electrodes are connected to the first lead-out portion, and each of the third and fourth side electrodes are respectively connected to the second lead-out portion.

12. The coil component of claim 10, wherein the first lead-out portion comprises first and second lead patterns disposed on the first surface and the second surface of the support substrate, respectively, and exposed to a first side surface of the both side surfaces of the body to be spaced apart from each other, the second lead-out portion comprises third and fourth lead patterns disposed on the first surface and the second surface of the support substrate, respectively, and exposed to a second side surface of the both side surfaces of the body to be spaced apart from each other, the first and third side electrodes are connected to the first and third lead patterns, respectively, and the second and fourth side electrodes are connected to the second and fourth lead patterns, respectively.

13. The coil component of claim 8, wherein each of the first and second extension portions surround both of the first and second cores.

14. A coil component comprising:

a body having a first surface and a second surface opposing each other, both side surfaces connecting the first surface to the second surface and opposing each other, and both end surfaces connecting the first surface to the second surface and opposing each other;

first and second coil portions embedded in the body and spaced apart from each other;

first and second side electrodes disposed on a first side surface of the both side surfaces of the body and connected to both ends of the first coil portion, respectively; and third and fourth side electrodes disposed on a second side surface of the both side surfaces of the body and connected to both ends of the second coil portion, respectively, wherein the first to fourth side electrodes include first to fourth external electrodes, respectively, extending from the first to fourth side electrodes, respectively, onto the first surface of the body, the first and second external electrodes include first and second protrusions, respectively, extending toward each other in opposite directions and were spaced apart from each other, and the third and fourth external electrodes include third and fourth protrusions, respectively, extending toward each other in opposite directions and were spaced apart from each other.

15. The coil component of claim 14, wherein the first to fourth side electrodes are disposed on edge regions of the both side surfaces, respectively, and spaced apart from each other, and the edge regions refer to regions at which the both side surfaces and the both end surfaces of the body are in contact with each other, respectively.

16. The coil component of claim 14, wherein the first to fourth external electrodes are disposed on corners of the first surface of the body and spaced apart from each other, and the corners contact the both side surfaces and the both end surfaces of the body, respectively.

17. The coil component of claim 14, further comprising an insulating layer disposed on an external surface of the body, except for regions of the external surface on which the first to fourth side electrodes and the first to fourth external electrodes are disposed.

18. The coil component of claim 14, wherein the body includes first and second cores spaced apart from each other, the first coil portion includes a first winding portion having at least one turn around the first core and a first extension portion extending from the first winding portion to surround the first winding portion, and the second coil portion includes a second winding portion having at least one turn around the second core and a second extension portion extending from the second winding portion to surround the second winding portion.

19. The coil component of claim 18, wherein the first and second coil portions further comprise:

a first lead-out portion connected to the first extension portion and exposed to the first side surface of the both side surfaces of the body; and a second lead-out portion connected to the second extension portion and exposed to the second side surface of the both side surfaces of the body.

20. The coil component of claim 18, further comprising a support substrate having a first surface and a second surface opposing each other and supporting the first and second coil portions, wherein the first and second coil portions further comprise:

a first coil layer disposed on the first surface of the support substrate; and a second coil layer disposed on the second surface of the support substrate and facing the first coil layer.

* * * * *